US005345724A

United States Patent [19]

Ng, Jr.

[11] Patent Number: 5,345,724

[45] Date of Patent: Sep. 13, 1994

[54] SANDING DEVICE FOR V-SHAPED SLATS

[76] Inventor: Patrick M. Ng, Jr., 1655 Walea St., Wahiawa, Hi. 96786

[21] Appl. No.: 45,724

[22] Filed: Apr. 14, 1993

[51] Int. Cl.[5] ..... B24B 23/04

[52] U.S. Cl. ..... 451/351

[58] Field of Search ..... 51/170 R, 170 TL

[56] References Cited

U.S. PATENT DOCUMENTS 2,343,237 3/1944 McElroy, Jr. ..... 51/170 TL
3,914,906 10/1975 Barnes ..... 51/170 TL
4,774,789 10/1988 Amalfi ..... 51/170 TL
5,209,022 5/1993 McCambridge ..... 51/170 TL

*Primary Examiner*—Roscoe V. Parker
*Attorney, Agent, or Firm*—Michael I. Kroll

[57] ABSTRACT

An improved sanding device is provided for various work surfaces which consists of an elongate wedge. Abrasive material is applied to work contact sides of the wedge. A mechanism is attached to a back end of the wedge, for vibrating the wedge with the abrasive material. The abrasive material can be used on V-shaped slats, bi-fold doors, shutters, casing, ornamental work and similar articles.

12 Claims, 2 Drawing Sheets

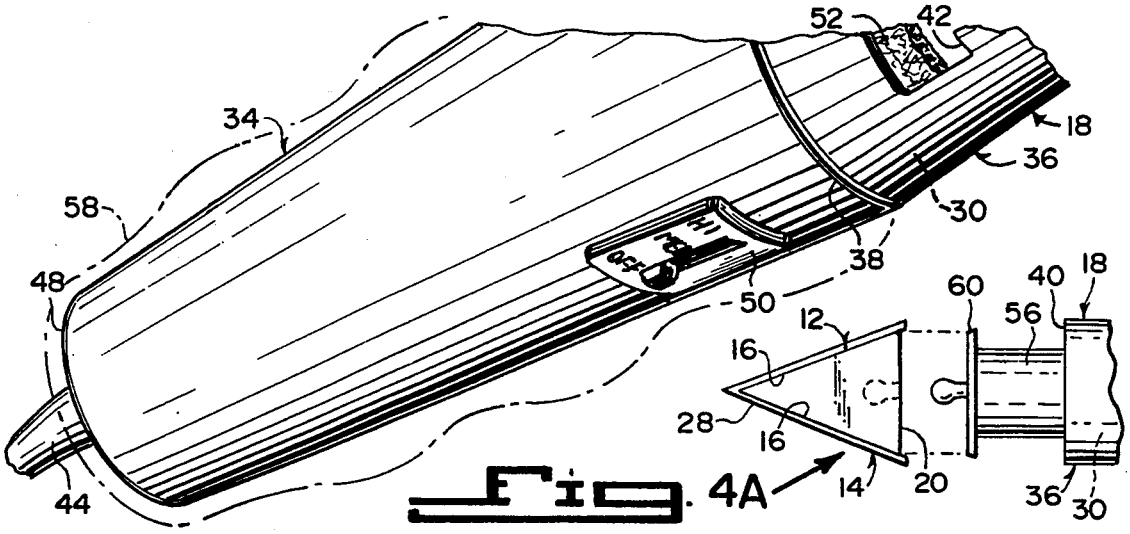
Fig. 4A
Fig. 3
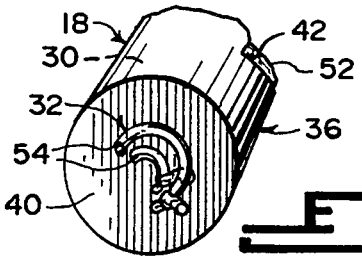
Fig. 3A
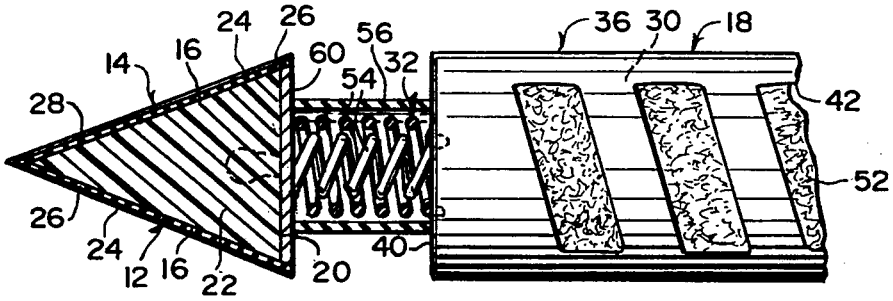
Fig. 4
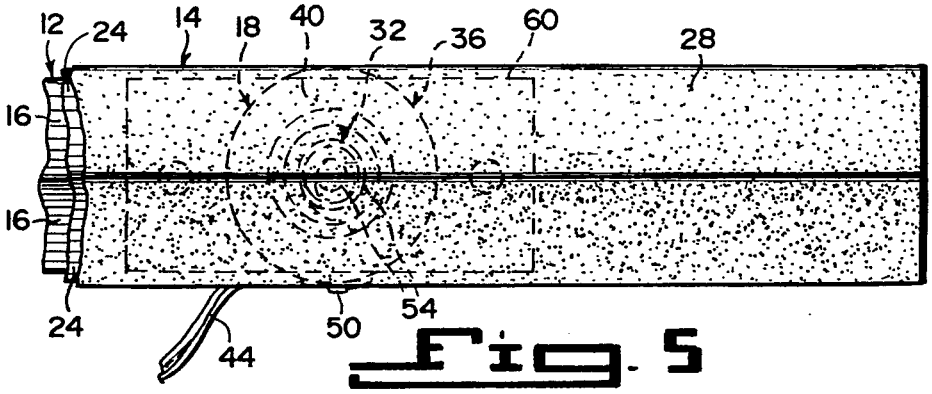
Fig. 5

SANDING DEVICE FOR V-SHAPED SLATS

BACKGROUND OF THE INVENTION

1. Field of the Invention

The instant invention relates generally to abrasion apparatuses and more specifically it relates to an improved sanding device.

2. Description of the Prior Art

Numerous abrasion apparatuses have been provided in prior art that are adapted to clean and finish exposed work surfaces on walls and floors from irregularities. While these units may be suitable for the particular purpose to which they address, they would not be as suitable for the purposes of the present invention as heretofore described.

SUMMARY OF THE INVENTION

A primary object of the present invention is to provide an improved sanding device that will overcome the shortcomings of the prior art devices.

Another object is to provide an improved sanding device that will save time and physical energy when used in the preparation and finish stages when painting bi-fold doors, shutters, casings and ornamental work.

An additional object is to provide an improved sanding device that is constructed to make full use of a peel and stick type sheet of sandpaper that is applied to an elongate wedge on the sanding device.

A further object is to provide an improved sanding device that is simple and easy to use.

A still further object is to provide an improved sanding device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 3 is a bottom perspective view with parts broken way taken in direction of arrow 3 in FIG. 1, showing the three way switch in greater detail.

FIG. 3A is a front cross sectional perspective view with parts broken away taken along line 3A—3A in FIG. 2.

FIG. 4 is a partial cross sectional view taken along line 4—4 in FIG. 2.

FIG. 4A is a partially exploded diagrammatic side view with parts broken away, showing the elongate wedge removed from the quick change action locking plate.

FIG. 5 is a front view with parts broken away taken in direction of arrow 5 in FIG. 2.

DETAILED DESCRIPTION OF THE PREFERRED EMBODIMENTS

Figure 1:
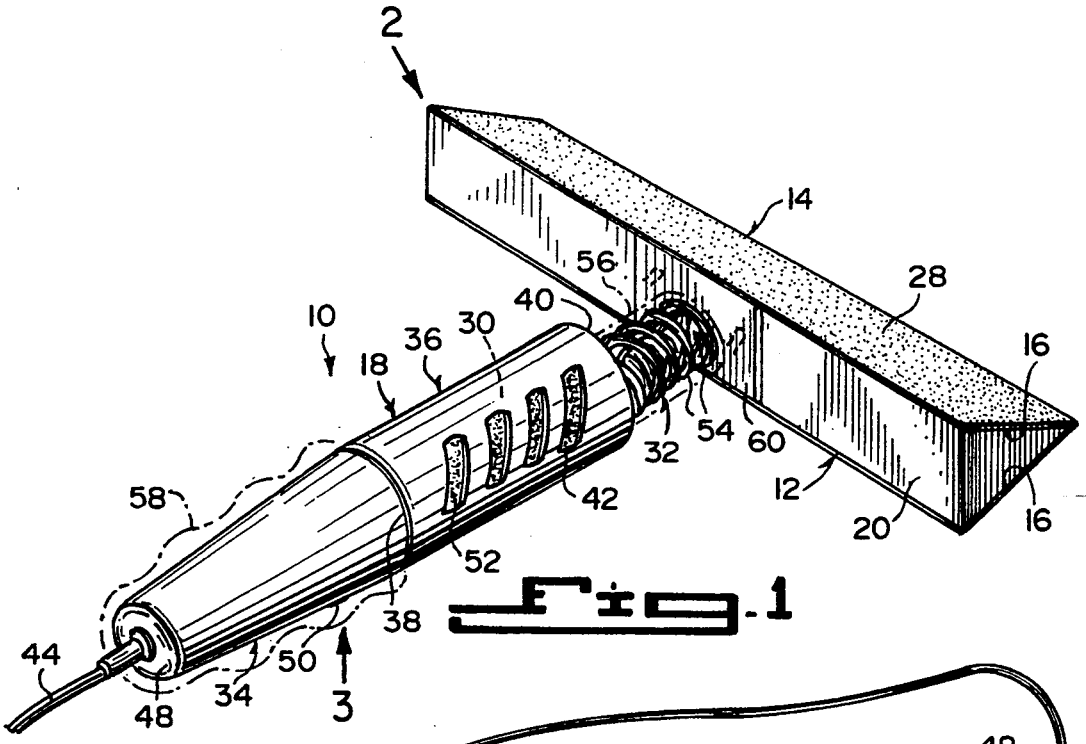
FIG. 1 is a rear perspective view of the instant invention.

Turning now descriptively to the drawings, in which similar reference characters denote similar elements throughout the several views, the Figures illustrate an improved sanding device 10 for various work surfaces which consists of an elongate wedge 12. Abrasive material 14 is applied to work contact sides 16 of the wedge 12. A mechanism 18 is attached to a back end 20 of the wedge 12 for vibrating the wedge 12 with the abrasive material 14. The abrasive material 14 can be used on V-shaped slats, bi-fold doors, shutters, casings, ornamental work and similar articles.

The elongate wedge 12 is fabricated out of a durable material 22. Padding 24 fabricated out of a resilient material 26, is positioned between the abrasive material 14 and the work contact sides 16 of the wedge 12 to cushion the abrasive material 14. The abrasive material 14 is a peel and stick type sheet of sandpaper 28, having adhesive that is applied to the padding 24 on the work contact sides 16 of the wedge 12.

The vibrating mechanism 18 includes an electric vibrator motor 30 and a structure 32 for coupling the electric vibrator motor 30 to the center of the back end 20 of the wedge 12. A frustum cone shaped handle 34 is provided to be gripped by a hand of a person. A cylindrical casing 36 extends from a wide end 38 of the handle 34 for retaining the electric vibrator motor 30 thereon. The casing 36 has a closed end 40 and a plurality of side vents 42 for cooling the electric vibrator motor 30.

The electric vibrator motor 30 contains an electric power cord 44 with plug 46 extending from a narrow end 48 of the handle 34. A three way control switch 50 is on the handle 34, that can be manually manipulated between an off, medium and high position, so as to operate the electric vibrator motor 30.

The improved sanding device 10 further includes fine foam burn resistant material 52 placed within the casing 36, so as to filter air through the side vents 42.

The coupling structure 32 consists of a pair of concentric coil springs 54 connected at each end to, and extending between the center of the back end 20 of the wedge 12 and the closed end 40 of the casing 36. A flexible sheath 56 fits over and protects the concentric coil springs 54 from the weather and marring surfaces.

The durable material 22 of the wedge 12 is hard plastic. The resilient material 26 of the padding 24 is soft rubber. A motorcycle type rubber hand grip 58 shown in phantom in FIGS. 1, 2 and 3 can fit over the handle 34 for a better grip and to reduce fatigue due to vibration.

Figure 2:
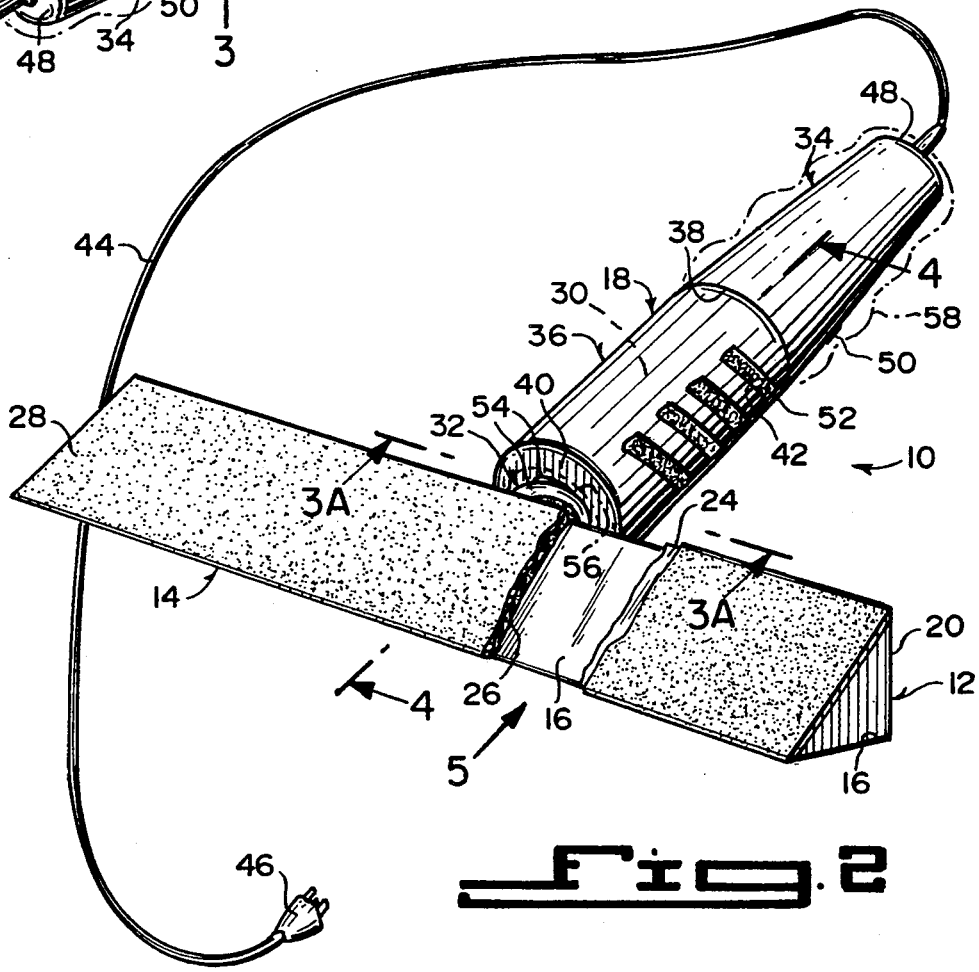
FIG. 2 is a front perspective view with parts broken away taken in direction of arrow 2 in FIG. 1.

A quick change action locking plate 60 can be provided between the back end 20 of the wedge 12 and an end of the concentric coil spring 54, as shown in FIGS. 1, 4 and 4A. Different sized and shaped wedges can now be utilized to allow for the use of different types of abrasive applicators, typically but not limited to a wedge one half the size of the original wedge 12 and a semi-spherical shaped wedge for pipes.

The various components of the improved sanding device 10 are typically but not limited to the following sizes:

1. The work contact sides 16 of the wedge 12 are two and one eight inches wide.
2. The back end 20 of the wedge 12 is one and one half inches wide.
3. The length of the wedge 12 is eight inches.
4. The length of the frustrum cone shaped handle 34 is three and three quarter inches.

5. The wide end 38 of the handle 34 is one and a half inches.
6. The narrow end 48 of the handle is one inch.
7. The length of the cylindrical casing 36 is three and one half inches.
8. The diameter of the casing 36 is one and a half inches.
9. Each side vent 42 is one inch in length.
10. The width of each side vent 42 is one quarter of an inch.
11. The power cord 44 is six feet long.
12. The padding 24 is one eighth of an inch thick.
13. The concentric coil springs 54 are one inch in length.
14. The diameter of the outside coil spring 54 is three quarters of an inch.
15. The electric vibrator motor 30 can be between three to three and one quarter inches in length.
16. The electric vibrator motor 30 can be one and a quarter inches in diameter.

To use the improved sanding device 10 a person must take the following steps:

1. Insert the plug 46 of the electric power cord 44 into a wall socket.
2. Grip the frustrum cone shaped handle 34 with one hand.
3. Slide the three way control switch 50 on the handle 34 to the medium or high position, with a finger to operate the electric vibrator motor 30.
4. Place the vibrating sandpaper 28 on the elongated wedge 12 against a work piece, so that the sandpaper 28 can smooth and finish the work piece.
5. Slide the three way control switch 50 on the handle 34 to the off position, to turn off the electric vibrator motor 30.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved sanding device for various work surfaces which comprises:

a) an elongate wedge, said elongate wedge being fabricated out of a durable material;
b) abrasive material applied to work contact sides of said wedge;
c) means attached to a back end of said wedge, for vibrating said wedge with said abrasive material, so that said abrasive material can be used on V-shaped slats, bi-fold doors, shutters, casing, ornamental work and similar articles; and
d) padding fabricated out of a resilient material, in which said padding is positioned between said abrasive material and said work contact sides of said wedge to cushion said abrasive material.

2. An improved sanding device as recited in claim 1, wherein said abrasive material is a peel and stick type sheet of sandpaper having adhesive that is applied to said padding on said work contact sides of said wedge.

3. An improved sanding device as recited in claim 2, wherein said vibrating means includes:

a) an electric vibrator motor; and
b) means for coupling said electric vibrator motor to the center of said back end of said wedge.

4. An improved sanding device as recited in claim 3, wherein said vibrating means further includes:

a) a frustrum cone shaped handle to be gripped by a hand of a person; and
b) a cylindrical casing extending from a wide end of said handle for retaining said electric vibrator motor therein, said casing having a closed end and a plurality of side vents for cooling said electric vibrator motor.

5. An improved sanding device as recited in claim 4, wherein said electric vibrator motor includes:

a) an electric power cord extending from a narrow end of said handle; and
b) a three way control switch on said handle, that can be manually manipulated between an off, medium and high position, so as to operate said electric vibrator motor.

6. An improved sanding device as recited in claim 5, further including fine foam burn resistant material placed within said casing, so as to filter air through said side vents.

7. An improved sanding device as recited in claim 6, wherein said coupling means includes a pair of concentric coil springs connected at each end to and extending between the center of said back end of said wedge and said closed end of said casing.

8. An improved sanding device as recited in claim 7, further including a flexible sheath which fits over and protects said concentric coil springs from the weather and marring surfaces.

9. An improved sanding device as recited in claim 8, wherein said durable material of said wedge is hard plastic.

10. An improved sanding device as recited in claim 9, wherein said resilient material of said padding is soft rubber.

11. An improved sanding device as recited in claim 10, further including a motorcycle type rubber hand grip which fits over said handle for a better grip and to reduce fatigue due to vibration.

12. An improved sanding device as recited in claim 11, further including a quick change action locking plate between said back end of said wedge and an end of said concentric coil springs, so that different sized and shaped wedges can now be utilized to allow for the use of different types of abrasive applicators, typically but not limited to a wedge one half the size of the original wedge and a semi-spherical shaped wedge for pipes.

* * * * *